United States Patent [19]

Lucek

[11] 4,357,222

[45] Nov. 2, 1982

[54] ELECTROLPHORETIC CASTING PROCESS

[75] Inventor: John W. Lucek, Worcester, Mass.

[73] Assignee: Norton Company, Worcester, Mass.

[21] Appl. No.: 290,034

[22] Filed: Aug. 5, 1981

[51] Int. Cl.[3] ..... C25D 1/14; C25D 1/20

[52] U.S. Cl. ..... 204/181 F

[58] Field of Search ..... 204/181 F, DIG. 8

[56] References Cited

U.S. PATENT DOCUMENTS

| | | | |
|---|---|---|---|
| 2,765,512 | 10/1956 | Nesbit | 25/156 |
| 2,942,991 | 6/1960 | Smith | 106/44 |
| 2,964,823 | 12/1960 | Fredriksson | 25/156 |
| 3,718,564 | 2/1973 | Ebrey | 204/181 |
| 3,882,010 | 5/1975 | Szabo | 204/181 |
| 4,092,231 | 5/1977 | Chronberg | 204/181 F |
| 4,121,987 | 10/1978 | Ryan et al. | 204/181 |
| 4,170,542 | 10/1979 | Chronberg | 204/181 F |

FOREIGN PATENT DOCUMENTS 2003183 3/1979 United Kingdom .

OTHER PUBLICATIONS

"'Elephant' Modernizes Whiteware Process", pp. 30–32 and 44, Ceramic Industry, May, 1980.

"Design of Cathodes for Electrophoretic Forming of Porcelain Cups" F. S. Entelis et al., Ceramic Industry, vol. 36, Jul. '80, pp. 683–685.

*Primary Examiner*—Howard S. Williams

*Attorney, Agent, or Firm*—Arthur A. Loiselle, Jr.

[57] ABSTRACT

The invention is an electrophoretic casting process which produces highly dense green castings with residual liquid e.g. water below 7%, and which eliminates excessive liquid and electrode degradation. This is accomplished by careful selection of slip viscosity, utilization of an impervious casting mold set-up in which only a minor part of the mold is conducting, application of a varying voltage cycle, and moving one electrode relative to the other.

26 Claims, 6 Drawing Figures

ELECTROLPHORETIC CASTING PROCESS

TECHNICAL FIELD

The invention relates to the casting of high density refractory or metal shapes. More specifically the invention is an electrophoretic casting process.

BACKGROUND ART

Prior Art Statement

The following publications are representative of the most relevant prior art known to the applicant at the time of filing the application:

U.S. Pat. Nos. 2,765,512, Oct. 9, 1956, R. A. Nesbit; 2,942,991 June 28, 1980, E. Smith; 2,964,823 Dec. 20, 1960, J. I. Fredriksson; 3,718,564 Feb. 27, 1963 J. A. C. Ebrey et al; 3,882,010 May 6, 1975 E. J. Szabo; 4,121,987 Oct. 24, 1978 William Ryan et al.

FOREIGN PATENT APPLICATION NO. 2,003,183A, Mar. 7, 1979, United Kingdom.

Other Publications

"'Elephant' modernizes Whiteware Process", pp. 30–32 and 44, Ceramic Industry, May, 1980.

F. S. Entelis et al, "Design of Cathodes for Electrophoretic Forming of Porcelain Cups"; Science For The Ceramic Industry, Volume 36, July 1980, pp. 683–685 (translated from Steklo i Keramika, No. 12, pp. 11–12, December 1979), Glass and Ceramics.

U.S. Pat. No. 2,942,991 to E. Smith discloses a basic casting process wherein an aqueous slip is cast into a conventional porous mold. The reference is relevant for its statement at lines 19–21 column 3, that the viscosity or the slurry used in the process is not critical and can be within a wide viscosity range. This was, at the time and reference issued, the belief of those skilled in the art; that is still the belief at the present time.

J. J. Fredriksson discloses the importance of a bimodal particle size distribution of the refractory particles contained in the slip as utilized in the more conventional porous mold slip casting process. He discovered that porosity, i.e. density, of the piece being cast, can be controlled by using a slip made up of about 50% of particles in the 0.1 to 8 micron range and 50% of particles in the 45 to 150 microns.

The Ebrey et al patent teaches an electrophoretic slip casting method for the casting of ceramic articles such as pottery, by combining conventional slip casting with electrophoresis. Ebrey et al utilize a conventional type porous plaster of paris mold which is then provided with a conductive coating of a low melting metal on the outside of said porous mold. A clay slip is cast into the porous mold and a short period of time is allowed to lapse as an initial cast-up period of e.g. 2–4 minutes. After this initial cast-up period, a metal electrode is immersed in the slip and a potential of 200–300 volts is applied; the metal of the electrode is not critical but is most desirably one that does not electrolyze too readily. Preferred electrode metals are alloys of tin, zinc and bismuth. Surplus slip and water is decanted and the green casting is partially dried and removed from the mold.

Another variant on the process of electrophoretic casting of inorganic materials, i.e. refractory particles, is that disclosed by Szabo. The reference recognizes the problem of gas evolution at the depository electrode when that electrode is, for example, a metal coating. The evolution of gas caused by electrolysis, results in cavities or holes in the cast shape. Szabo solves this problem by replacing the prior art metal coating on the mold with a porous conductive coating of graphite and powdered refractory pig graphite and alumina or silica. The pores of this coating allow the gas bubbles to migrate away from the refractory material being electrophoretically deposited using a potential of 1–10 volts/cm. The mold form on which the graphite-refractory coating is applied, is made of wax or a thermoplastic polymer. The deposited refractory shape is dried and the wax (or plastic) mold melted away freeing the casting.

The Ryan et al reference is also primarily concerned with the gases generated during electrophoretic casting of a ceramic or refractory aqueous slip and solves the problem with a porous depository mold. In a preferred embodiment the conductive casting mold, in its entirety, is porous and is fabricated from a mixture of powdered carbon and particulate inorganic material like clay, silicon carbide, cement, aluminum phosphate, thermosetting resin, and the like. In the alternative, the main body of the mold may be constructed of plastic with a porous, carbonaceous conducting surface or coating, only on the operative surface of the mold, i.e. the surface on which the refractory slip will be deposited. Ryan et al. recognize that the size of the pores in the conductive mold are critical if optimum removal of generated gases is to be accomplished. Accordingly, the particle size of the powdered materials used to form the conductive mold are carefully selected and formed so as to produce a mold with the desired porosity. This is accomplished by using only graphite and other materials that have a maximum particle size of from 70 to 200 microns. The other electrode may be a metal such as zinc or may be a carbon based material similar to that of the depository mold. Ryan et al use an anode-cathode potential of about 50 to 80 volts, but recognize that lower or higher potentials may be used depending on the size of the casting being formed. The method usually involves a drying step subsequent to the casting phase of the process and prior to firing.

The British application No. 2,003,183A discloses electrophoretic slip casting of ceramic parts by applying a potential to a slip of ceramic powder by way of a metal container holding the slip functioning as one electrode and a mandrel functioning as the depository electrode. The potential is applied and the mandrel is preferably rotated, particularly if tubes are being produced; the mandrel can, however, be any shape desired. According to the reference, the porosity of the cast pieces can be varied by varying the particle size of the ceramic material in the slip. After completion of the casting step, the green casting is dried, isostatically pressed and the mandrel removed. The final step in the process is firing of the pressed, green shape. These parts are fairly thin walled, in the order of 5 mm.

The Ceramic Industry, May 1980 article is a description of a commercial electrophoretic process for the production of whiteware. It is relevant for its teaching of the use of a potential of 23 volts, zinc coated electrodes and the fact that the cast product is still flexible and contains 10–18% by weight of water. This equipment produces only ribbon or plate stock.

F. S. Entelis et al. disclose an advancement in the electrophoretic casting art whereby the cathode, the non-depository electrode, is one or more metallic strips bent in specific configurations to create a uniform distribution of potential gradients in the system thus providing optimum deposition of the slip particles on the depository electrode i.e. the anode. It was also found by these workers that either the anode or cathode must be rotated. The full outer surface of the shape being formed is defined by the entire anode. The major distinction between the teachings of Entelis et al and the present invention is that in the latter the anode, that is the depository electrode, makes up substantially less than the complete surface of the shape being cast; thereby greatly reducing the interactions between slip, electrodes, and applied voltage which cause hydrolysis. The use of partial electrodes reduces the requirements of uniform fields to obtain uniform thicknesses in that additional surfaces (including those of non-uniform wall thickness which cannot be controllably produced by the referenced technique) can be defined by electrically inactive surfaces.

The Nesbit reference teaches freezing of a green slip cast article to facilitate removal from the mold. This well known method can be employed in the process of the present invention for the same purpose, and may even be modified by vacuum removal of the residual water prior to thawing.

In all cases, the voltage utilized throughout the prior art, has been straight or pure DC voltage. The present invention utilizes AC signals imposed on DC potential reference voltages as well as straight DC potential.

DISCLOSURE OF THE INVENTION

The invention is an improved electrophoretic casting method wherein only a part of the shape defining portion of the casting mold set-up is electrically active i.e. the depository electrode is only a part of the shape defining portion of the mold as compared to the prior art in which the entire mold set-up or the complete surface of the shape defining portion of the mold set-up is electrically conductive. This allows the deleterious interaction of slip hydrolysis and electrode corrosion products, noted in most prior art methods, to be reduced or isolated in a portion of the casting where such degradations do not damage the casting's end properties.

This factor and modifications described below allow the use of higher potentials for casting without severe microstructural heterogeneities. The primary result of the invention process is very dense, high strength green castings which contain substantially less slip liquid than prior art green castings.

In addition, the present invention overcomes the major problem inherent in the prior art methods, of gas formation at the depository electrode from electrolysis of the slip liquid which causes microstructure flaws in the cast part. This is accomplished primarily because in the mold set-ups of the invention, the depository electrode makes up only a minor part of the shape defining portion of the mold in contrast to the prior art wherein the depository electrode makes up essentially the entire shape defining surface; this is usually the positive electrode or anode. Examples of this are shown in the Entelis et al, Ebrey, Ray et al and U.K. 2,003,183A references. Thus, by reducing gas formation at the anode, the undesirable problem of porous surfaces in the casting is eliminated or localized. A further modification to the prior art methods is the use of a reduced voltage at the onset of casting. This greatly reduces electrode corrosion by electrochemical action. Once a cast layer is deposited on the electrode, the electrode is substantially protected from corrosion by long diffusion paths. The voltage may be increased to speed casting rate and increase the attraction of the suspended particles for the depository electrode. This increased attraction results in denser castings of a rigid nature with minimal water content. The increased casting rate allows the use of less "stable" non-colloidal suspensions of coarser grain size which further increase casting density.

A third method is brought to fore which further reduces electrolysis and corrosion. Most prior art refers to electrolysis of the slip liquid as the primary cause of porosity in castings. While they recognise that electrode corrosion play a role here, experience has shown that electrode corrosion is the major problem, not electrolysis. Judicious choice of electrode materials inert with respect to both the slip electrolyte at the casting voltage and the bound defloculating species on the slip particles can nearly eliminate the "so-called electrolysis" problem.

Throughout the specification the term "depository electrode" is used. While that term is in the singular, it is intended to cover embodiments of the invention in which more than one depository electrode is actually employed in a given mold set-up. In some cases the mold set-up may contain several pairs of electrodes with one pair only being active at a given time but more than one pair may be used at a given time, if that is desired or appropriate.

Similarly, the term "voltage" as used herein is intended to mean direct current voltage, so-called clipped AC, and clamped AC voltages, unless otherwise specified. Use of clipped and clamped AC potentials has been shown by the present disclosure to even further reduce the electrode corrosion and hydrolysis problems. While the reasons are not clear, it is assumed that cyclic reductions in potential (including polarity reversal) reduce the net driving force behind the electrolysis and corrosion mechanisms.

When the expression "moving electrode" is used in the specification and claims, it is contemplated that the term means mechanical movement i.e. actual physical movement of one or more electrodes, and, electrical movement where the potential is moved or relocated within the mold set-up by applying a potential alternately or serially to series of electrodes contained in the mold set-up. This phenomenon of a moving electrode will be described in more detail below.

In its preferred form the process of the instant invention is directed at electrophoretic casting of charged particles of any kind; insoluble metals, inorganics, organometallics, and the like.

The material of which the non-electrode portion of the mold set-up is most advantageously made is an impervious insulating material. Such materials may be flexible e.g. silicone, nitrile, hydrocarbon rubber and the like, or it may be a chemically or thermally removable material like wax, thermoplastics or the like. However, water absorbent materials such as plaster of Paris may also be used. The use of these electrically inactive materials as shape defining surfaces reduces slip interactions and results in greatly improved surfaces (smoother) and facilitates mold release compared to prior art mold materials where the cast piece has adhered to the entire mold and release is difficult.

The casting slips operable within the present invention are, in general, all known slips be they suspensions of metal particles or particles of a refractory material. Details of acceptable slips are set out in the Smith reference and include alumina, silicon nitride, silicon carbide, chromite, silica, sillimanite and zirconium silicate as well as other refractory materials and mixtures of refractory materials of a particle size that will pass through a 200 mesh (British Standard sieve). However, in its preferred form the present invention employs slips more closely resembling those taught by the Fredriksson reference. These preferred slips have a bimodal particle size distribution made up of 40 to 90% by weight of particles having an average particle size of from 1 to 8 microns and from 10 to 60% by weight of particles in the 45 to 150 micron range. While the viscosity is not absolutely critical it is preferred that the viscosity of the slip be maintained between about 0.5 to 100,000 centipoises, with the ideal viscosity being from 0.5 to 4,000 centipoises. The amount of solid particles in the slip is most desirably from 45 to 90% by weight with the remainder being the slip liquid. As noted above, the described invention allows the use of less stable slips with higher solid content than mentioned in the prior art. These higher density slips (75–90% by weight solids) partially provide for the improved density castings produced by this invention.

Normally a deflocculating agent is added, however, it is not absolutely necessary. The preferred deflocculants are sodium silicate, sodium dioctylsulphosuccinate, sodium polyacrylate, ammonium polyacrylate, ethylamine, methyl amine, triethanolamine and such trademarked materials as Tamol, Darvan, and wetting agents in general. Any species, including simple ionic electrolytes, which develop sufficient charges on colloidal particles to stabilize a casting slip may be used. The primary concern is that a charged particle be present, not the method used to obtain it.

As mentioned supra, the essence of the present invention resides in the discovery that improved electrophoretic casting can be carried out by utilizing a depository electrode (anode) that is only a small portion of the shape defining surface of the mold. In addition to the major advancement over the prior art of eliminating or greatly reducing the damage to the surface of the casting caused by generation of electrolysis byproducts at the anode, the present process greatly reduces electrochemical corrosion of the electrodes and is extremely versatile with respect to the variety of shapes of products that can be cast. The advantages and versatility of the invention will be made more apparent by the following discussion, with reference to the several figures of the drawing.

FIGS. 1 and 2 show an electrophoretic casting mold for the formation of dense refractory spheres, FIG. 1 being a sectional view of a mold set-up taken through 1-1 of FIG. 2. That part of the mold set-up identified as 1 in FIGS. 1 and 2, is the main body of the mold which contains therein, spherical cavities 2. The spherical cavities are connected to the exterior surfaces 3 and 4, by open channels 5 and 6. The mold body is located in a sealed arrangement on metal plate 7 which has an electrical terminal 8 affixed thereto. A casting slip is prepared and poured into the reservoir 9 until the cavities 2 are filled and the reservoir 9 is also filled to just short of the top lip or edge 10. On top of the mold set-up is placed a metal plate 11 with a downwardly extending member 12 which makes contact with the slip contained in the reservoir 9; metal plate 11 includes an electrical terminal 13. The terminals are then connected to a source of current in such a manner that the exposed small areas 6 of the metal plate 7 become the anode. A potential is created and maintained from 7 and 11 through the slip in contact with said plates through openings 5 and 6 in the main body of the mold. The slip particles migrate in the downward direction toward the anode or bottom plate 7 causing densification of the particles and elimination of the slip liquid which is attracted to the reservoir 9 containing the anode as the spherical cavities 2 fill with slip particles. When the electro-deposition process is completed i.e. the spherical cavities are filled with solid particles, the electrophoretic process is discontinued, the electrode 11 removed, the excess slip decanted and the green cast spheres removed from the main body 1 of the mold set-up and fired.

If the main body 1 of the mold set-up is made of a resilient polymer such as a silicone rubber, the spheres may be simply popped out. However, if some other more rigid non-conducting material is used, the main body 1 of the mold set-up should be of the split mold type. It may also be convenient to freeze the green spheres in the mold prior to removal therefrom, in order to insure against damaging the spheres during removal.

Prior art methods capable of sphere formation would require that the surface of the sphere be essentially surrounded by a conductor. The corrosion of the electrode and hydrolysis would yield a porous surface. If the ball is to be used as grinding media or rolling contact bearing elements a porous surface is very undesirable. Conventional plaster casting and prior art electrophoretic casting will give poorer surface finishes than the present invention. Conventional plaster casting cannot form a solid ball. As the liquid is withdrawn there is no new source of solids to replace the liquid, therefore a large pore occurs within the casting. In larger balls, conventional casting will give a density gradient radially which, on firing or sintering, will cause fracture. Attempting to cast without a coherent method of withdrawing liquid i.e. filling an impervious cavity, will eventually result in a solid part through evaporation of the slip liquid. However, the part will be heavily flawed due to density gradients within the piece.

FIG. 3 is a electrophoretic casting mold for the formation of a ceramic ring seal. The main body 14 of the mold set-up defines the outside configuration of the ring seal by the channels 15 and 16 therein; the inside of the ring to be cast is defined by the arbor 17. Both the arbor 17 and the main body are placed, in sealing arrangement, on metal plate 18 which includes electrical terminal 19. The plate 18 is to function as the depository electrode i.e. the anode. A second electrode 20 is provided and may conveniently be ring shaped as shown in FIG. 3. The two electrodes 18 and 20 are connected to a source of current so that electrode 18 becomes the anode or depository electrode. It can readily be seen from the drawing, that part 21 of the anode 18 that will actually function as an electrode in the electrophoretic process, is only a minor part of the shape defining surface areas of the mold set-up. Casting slip is poured into the mold set-up until it makes contact with the upper electrode 20. A potential is applied which cause migration of the suspended slip particles toward the anode 18 and specifically that part thereof designated as 21. The potential is maintained until electrodeposition has filled the shape defining cavity in the mold set-up i.e. that volume defined by 15, 16, 17, 21 and 22. Once the thickness of the casting has reached 22 in FIG. 3, the electrophoretic process is terminated. The slip liquid (electrolyte) will not substantially occupy the volume above the casting proper. The green casting is then removed from the mold and fired. All parts of the mold set-up, except the electrodes 20 and 21 are composed of an electrically nonconductive material. The material may be a very flexible rubber e.g. silicone rubber or any more rigid nonconducting material. In this case the casting is of such a configuration that the main body 14 of the mold set-up, is preferably in two parts. However, if the green casting is frozen first, a very flexible one piece main body may be used.

Conventional slip casting can form a part such as this in a porous mold but extraction from the rigid plaster is difficult, often damaging both the part and the mold. For a ½ inch thick seal, casting time will be much in excess of ½ hour. The embodiment shown in this figure is much faster. The prior art electrophoretic method might also form a shape such as this, albeit at a lower density as described previously. However, the use of partially porous molds or conductive definition surfaces for the circumferential groove will cause the same difficulties as for plaster molds.

FIGS. 4 and 5 are a sectional view and an elevated top view respectively of a mold set-up, according to the invention, for electrophoretic casting a U-shaped channel piece using a moving electrode. Again in this case the main body 23 of the mold set-up and the concave surface defining element 24 are composed of an electrically nonconductive material and preferably a flexible silicone rubber. The depository electrode 25 runs essentially the full length of the main body 23 and makes up a very small part of the convex shape-defining surface 26 of the mold set-up. The total shape of the piece to be cast is shown as 27 in FIGS. 4 and 5. The anode is a bar of metal having a terminal thereon and including downwardly extending protrusions 30. The anode also includes an electrical connector or terminal 31 shown in FIG. 5. The mold set-up is assembled as shown and connected to an electrical supply. A casting slip is poured into the shape defining cavity 27 up to a point which causes the slip to contact the downwardly extending protrusions 30. A potential is applied and electrodeposition of the slip particles takes place in a downward direction toward the anode 25. At the commencement of the electrodeposition, it is preferred that the anode 28 be located at one of the extreme ends of the mold set-up. When that end of the shape defining cavity is filled to the desired degree, the anode is moved toward the opposite end incrementally until it has traversed the entire length of the cavity 27. This incremental movement results in full and uniform filling of the cavity. When deposition is completed the potential is terminated, the mold set-up disassembled and the green casting removed. The main body 23 of the mold set-up is ideally composed of a flexible nonconducting material such as a silicone rubber. With cast product as simple in design as this U-shaped channel there is no need to freeze the green casting in order to facilitate removal from the mold set-up without damage. The green casting is then fired in the conventional manner.

Conventional slip casting in plaster molds is capable of forming such parts as illustrated, but experience indicates that with parts of varying cross section, the casting, due to decreasing capillary action as casting thickness increases, will include density gradients which make for firing or strength problems. Prior electrophoretic art may also form this shape but the motion of the electrode described above, equalizes the applied voltage and results in a uniformly applied field. The uniformity of this field results in uniform attractive forces in the mold, hence, uniform microstructures. The prior art, with non-traversing electrodes, will give density gradients which reduce strength or increase firing losses.

A further variant on the moving electrode concept is shown in FIG. 6. In this case, however, the depository electrode is not moved physically but rather is moved electrically. FIG. 6 is an electrophoretic mold set-up for casting a tube. While the geometry of a tube is relatively simple, it is a difficult configuration to cast to closely defined inner and outer diameter dimensions. However, by moving the depository electrode along the length of the tube mold during electrophoresis, very dense green tubes result that have very precise dimensions and that are low in water content. The main body 32 of the mold set-up is formed of an electrically non-conductive material and is preferably tapered very slightly inwardly from top to bottom. The core or center arbor 33 is also constructed of an electrically nonconducting material and is located centrally within the cylindrical cavity defined by 32 and seated in a recess provided therefor in the bottom portion of the main body 32. A series of ring electrodes 35 through 42 are contained within the wall of the cylindrical main body 32 of the mold set-up and make up part of the latters inner wall. Each ring electrode is wired 43 to an electrical means for applying a potential between two of the ring electrodes at a given time and with the capability of moving the electrode pair up or down the series of electrodes. For example, when electrophoresis is started, electrode pair 40 and 42 are electrically activated forming the anode and cathode, respectively; when desired, electrodes 40 and 42 are electrically disconnected and electrodes 39 and 41 are made active, and so on up the series of electrodes to the final pair 35 and 37. In forming a green refractory tube, slip is poured into the cylindrical cavity 44 formed by the main body 32 and the arbor 33. The first electrode pair 40–42 is activated and the potential maintained until it is nearly zero between 41 and 42 which indicates that the bottom part of the casting being formed has reached that electrode 41. At this point electrode pair 40-42 is disconnected and the next electrode pair 39-41 is activated and remains so until the potential of 41-40 is nearly zero at which point the procedure is repeated with the 38-40 pair and so on up the full length of the mold set-up. The slip liquid, throughout the foregoing sequence of steps, is gradually migrating to the top of the mold set-up. When electrodeposition of the slip has taken place, the electrical input to the mold set-up is terminated and the green refractory tube is removed from the mold set-up and subsequently fired.

Slip casting of tubes by both electrophoretic or capillary dewatering is a well defined process. Solid cast or drain cast tubes (capillary dewatering) with wall thicknesses greater than ¼" are difficult because the long casting times require very stable slips to reduce settling. The hydrostatic slip head, in large pieces, may result in density variations. Drain casting thicker than ¼" is complicated by radial density gradients (drying and firing cracks) and solid castings usually contain internal pores.

Prior art electrophoretic casting methods consider tube formation at length. The techniques presented are primarily for thin walled tubes having ⅛" thick walls or thinner. Attempts to duplicate tubes according to the prior art has shown this to be a limiting thickness. Due to the large electrode areas involved, it is difficult to maintain constant potentials and thicker castings crack on drying. One patent goes as far as isostatic pressing the electrophoretic casting to increase strength and density. This additional step and the thickness limitations are overcome by the method of the present invention.

While the foregoing is directed specifically at thick walled tubes, other thick walled shapes, such as plates, may be formed in this manner.

Mold forming methods are well known and therefore will not be discussed at any length. The only distinction between the molds of the instant invention and prior art molds is that in the invention process the mold must be cast around metal electrodes in many cases such as the last two types of mold set-ups described above. This conformance is required to reduce slip leakage at electrode/insulator interfaces.

The electrode materials may be any electrically conductive material. Particularly suitable are steel, galvanized steel, iron, chromium, Monel metal, tantalum, titanium, copper, nickel, bronze, brass, silver, gold, platinum, silicon carbide, silicon impregnated silicon carbide, metal-polymer composites, and conductive organic polymers. In some special cases, where an extremely smooth finish is desirable, the depository electrode may be liquid mercury.

The voltages or potentials referred to above may be DC or AC potentials where the AC varies around a reference voltage. The use of substantially "clipped" or rectified AC voltage or DC voltage with a minor AC component (clamped AC) reduce electrode corrosion substantially.

These voltages, either DC or modified AC, may be maintained constant, however it is preferable to begin the electrophoretic casting process by initially applying a very low potential e.g. 0.05 to 20 volts for a period sufficient to cause deposition of a thin layer of slip particles, be they metal or refractory, on the anode or depository electrode. This low voltage reduces significantly electrochemical corrosion of the anode and electrolysis of the slip liquid. The thin layer of deposited particles and included electrolyte then function both as a protective coating on the anode and subsequently as the anode itself. At this point the potential may be increased e.g. to 5 to 1000 volts to cause a reasonably rapid deposition of slip particles.

Pure AC potentials do not result in beneficial casting. Results with minimal clipping show only resistive drying (heating) or boiling of the slip.

The applied voltage may be maintained constant or it may be varied. In carrying out the present processes described above it is preferable to vary the applied voltage. As the thickness of the casting increases as the deposition process progresses, the effectiveness of the applied potential is gradually decreased by the increasing resistance of the layer being built up, thus less voltage is effective on the depository electrode, and the attractive force decreases. The result is a measurable density gradient through the thickness of the casting, especially beyond a thickness of 15 mm, which frequently causes drying cracks. Thus it is desirable to maintain the functional voltage at the depositing interface at about the level of the initial applied voltage. This can be accomplished by using a constant current input. The operable constant current levels are anything greater than zero amp/in$^2$ through 1.5 amp/in$^2$ and preferably between some value slightly greater than zero to about 0.5 amp/in$^2$ of depository electrode.

EXAMPLES OF THE PREFERRED EMBODIMENTS

Example I

Figure 1:
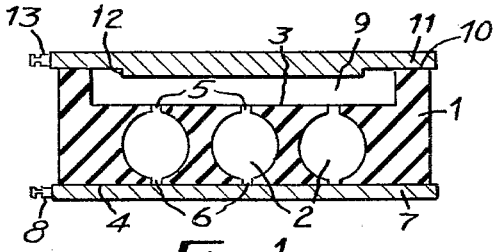
FIG. 1 is a sectional view of an electrophoretic casting mold set-up for the formation of solid spheres.
Figure 2:
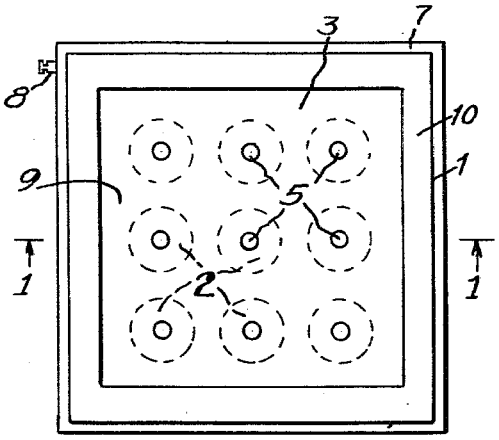
FIG. 2 is an elevated top view of the mold set-up of FIG. 1.

Solid, high density silicon carbide spheres were cast in the following manner:

The main body of a mold set-up shown as 1 in FIGS. 1 and 2, was formed using conventional mold forming techniques and utilizing RTV 700 silicone resin and B-4 curing agent, both supplied by the General Electric Company. This silicone rubber was very flexible thereby allowing the steel balls used as the patterns for cavities 2 in FIGS. 1 and 2, to be easily pushed out of channels 5 or 6 which easily expanded or stretched to the diameter of the steel balls. This feature of this material is also critical for the removal of the cast green silicon carbide spheres later in the process.

Still referring to FIGS. 1 and 2, the remainder of the electrophoretic mold set-up was provided by means of copper plate 7 to which the main body 1 was sealed; plate 7 was to function as the depository electrode i.e. the anode and included electrical terminal 8. The upper electrode 11 was brass and had the configuration shown in FIGS. 1 and 2 with a downwardly extending portion 12 for contacting the slip once the latter was placed in the mold, and included electrical terminal 13. When in position the brass electrode 11 made contact around its periphery 10 and the main body 1 of the mold set-up. As can be seen from the drawing the spherical cavities 2 were open to copper plate electrode 7 through openings 6 in the main body 1 of the mold set-up and likewise were open to the reservoir 9 through openings 5.

A suspension or slip of high purity silicon carbide was prepared in accordance with the method described in U.S. Pat. No. 2,964,823 which is incorporated herein by reference. The silicon carbide was bimodal i.e. 50% by weight, of through-100-on-325 mesh (Tyler Sieve Series) and 50% by weight of with an average particle size equal to or less than 5 microns. The slip was composed of 86% by weight of the aforedescribed silicon carbide, 13.9% by weight of water and 0.1% by weight of sodium silicate, the latter being a deflocculant.

The top electrode 11 was removed from the mold set-up and the slip was injected into each of the spherical cavities 2 until each was completely filled up to and including the upper connecting channels 5. Additional slip was poured into the reservoir 9 to such a level that when the upper electrode was put in place, the downwardly extending portion 12 thereof, made contact with the slip. At this point there was a continuous path of slip from the anode 7 through the lower channels 6, the spherical cavities 2, the upper channels 5, and the reservoir 9 to the lower portion 12 of the upper electrode 11.

The completely assembled mold set-up was connected to a direct current (DC) power supply through a variable transformer and a rectifier bridge circuit, by means of electrical terminals 8 and 13 on electrodes 7 and 11 respectively. The circuit was such that electrode 7 was the anode and electrode 11 the cathode. An initial voltage of about 10 volts was applied for 30 seconds. The potential was then gradually increased to 150 volts over a period of 1 minute and held at that voltage for 15 minutes. This caused the silicon carbide particles, which are electrically negative with respect to the slip liquid, to rapidly migrate toward the anode, i.e. the bottom electrode 7. The voltage was terminated.

The mold set-up was disconnected electrically and disassembled, freeing the main body 1. The electrophoretically formed silicon carbide spheres were pushed through openings 5 in the mold body 1 which were easily stretched to accommodate the size of the balls; the sprues formed by channels 5 and 6 were removed. "Wet" bulk density was calculated to be 2.93 g/cc with a liquid content less than 6%. The castings exhibited a dried bulk density of 2.79 g/cc 87% of theoretical SiC density. This is considerably higher than the density claimed in Fredricksson's patent for conventionally cast, similar compositions. The surface of the spheres, except for sprues, was highly smooth, smoother than possible if an electrode/slip interaction had taken place. Casting time for this part in capillary molds would be 20–25 minutes withh the microstructural problems described earlier.

The pieces were dried overnight at 80° C. prior to firing at 2000° C. for 15 minutes in an induction furnace under an argon atmosphere. The fired balls were recrystallized silicon carbide and had a diameter of 10.87 to 10.97 mm and a density of 2.75 g/cm$^3$ which was 86% of theoretical density. With the exception of the spots where the sprues were removed from the green cast balls, the surface was smooth and essentially pore free. Analysis of these balls after sectioning showed no density gradient through the thickness of the balls and a maximum pore size of about 50 microns. The uniformity of density obtained was better than that of prior practice.

EXAMPLE II

Figure 3:
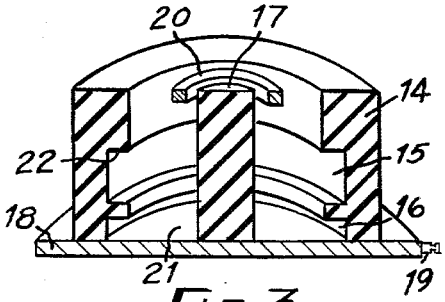
FIG. 3 is a perspective view of a casting mold set-up for casting a ring seal.

A silicon carbide seal blank was formed using the mold set-up shown in section in FIG. 3. A pattern for the seal blank containing an O-ring sealing groove was used to cast the main body 14 of the mold set-up in the known manner and using the curable silicone rubber system described in Example I. The main body 14 of the mold set-up was then adhesively attached to a brass, disc-shaped electrode 18 which included electrical terminal 19. A nonconducting arbor 17 was centered and affixed to the electrode 18. A second electrode 20 was then positioned as shown in FIG. 3. The shape of the seal blank to be electrophoretically cast, was defined by the surface 21 of the electrode 18. The surfaces 15, 16 and 22, and the ridge located between surfaces 15 and 16.

The two electrodes 18 and 20 were electrically connected in the same manner as in Example I with electrode 18 being the anode i.e. the depository electrode, and 20 the cathode.

A silicon carbide slip was prepared as described in Example I. The inner surfaces of the silicone rubber main body 14 of the mold set-up was given a thin coating of glycerol monooleate to increase the wettability of the silicon rubber surfaces in order to minimize the possibility of entrapped air. The entire mold set-up was placed on a vibrating table and filled with slip up to a point where the slip made contact with the upper electrode 20; the filling was done while the mold set-up was being vibrated.

An initial voltage of 20 volts DC was applied with a resulting current of 80 milliamps; this voltage was amintained for about a minute. The voltage was then gradually increased to about 150 volts so as to maintain a current of about 80 milliamps or below. After 10 minutes the amperage had dropped to about 10 milliamps which was an indication that nearly all of the solids had plated out of the slip. The electrode 20 was removed and electrode 18 disconnected. The spent slip liquid was poured off. Because the shape of the seal blank was a relatively fragile one in the green state, it could not always be removed at this point without causing damage. Therefore the mold set-up was subjected to a temperature of −120° F. for 15 minutes which caused the small amount of water remaining in the green casting to freeze, rendering the casting rigid. The anode 18 and arbor 17 were easily removed from the mold set-up. Because the green casting was frozen, the silicone rubber main body 14 of the mold set-up could be distorted sufficiently to remove the casting undamaged. The green casting was dried overnight at 70° C. and fired as described in Example I.

Casting and stripping time was less than ⅓rd that required to form this shape by plaster casting (capillary) techniques. The casting was smooth all over; turning marks from the original pattern were completely defined. The bulk density of the frozen castings were 2.83 g/cc–2.87 g/cc with 4.8–6.3% retained liquid. The dried bulk density of 5 consecutive castings was greater than 2.70 g/cc. This exceeds the density claimed by Fredriksson. The castings were rigid and were stripped from the mold immediately after the casting process terminated which would not be possible if the casting was done according to the prior art. Further experience showed that about 10% loss by breakage occurred, so freezing was included. Similar pieces without the O-ring groove may be immediately stripped without freezing.

EXAMPLE III

Figure 4:
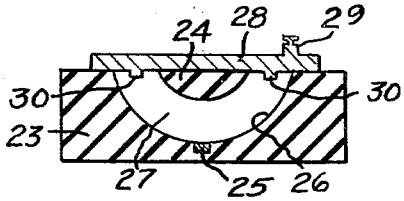
FIG. 4 is a sectional view of an electrophoretic casting mold set-up for producing a U-shaped channel piece.
Figure 5:
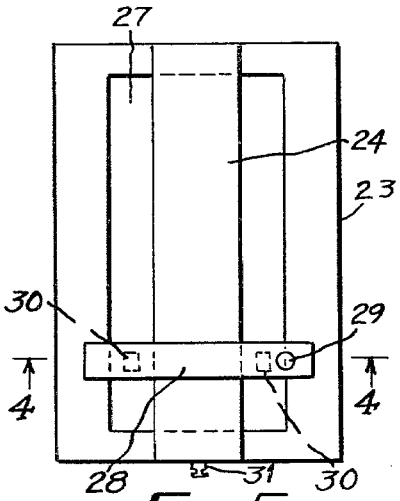
FIG. 5 is an elevated top view of the mold set-up of FIG. 4.

FIGS. 4 and 5 show a sectional view and an elevated top view respectively of a mold set-up for electrophoretic casting of a refractory trough, wherein the cathode was movable and the anode, i.e. the depository electrode, had a narrow strip like configuration located in the bottom of the main body 23 of the mold set-up.

The main body 23 of the mold set-up was formed in the known manner using RTV 664 from General Electric Company. A scalpel was used to cut a slot in the bottom of 23 into which was placed the brass electrode 25; a terminal 31 was affixed to electrode 25 through one of the walls of the silicone rubber main body 23 of the mold set-up. The surface defining the concave side of the casting was a hemispherical rod 24 composed of cured phenol-aldehyde resin which was held in place in depressions provided therefor in the main body 23. The cathode 28 was essentially a rectangular block with two downwardly extending protrusions 30 and a terminal 29 on its upper side.

A casting slip was prepared like that employed in Example I and poured into the cavity 27 of the mold set-up. The two electrodes 25 and 28 were electrically connected in the manner described in Example I with 25 as the anode and 28 as the cathode. The cathode 28 was located at one end of the mold set-up and a DC potential of 150 volts was applied and maintained for 7 minutes with the cathode 28 in a fixed position. The cathode 28 was then moved incrementally along the top of 24 at a rate of about 7 mm/min. taking about 20 minutes to traverse the entire length of the mold cavity 27. Moving the cathode 28 in this manner brought about full formation of the casting without the formation of hot spots and without the generation of a significant amount of gas at the anode 25. The mold set-up was electrically disconnected, disassembled, and the casting removed. The green casting was dried and fired as described above.

EXAMPLE IV

Figure 6:
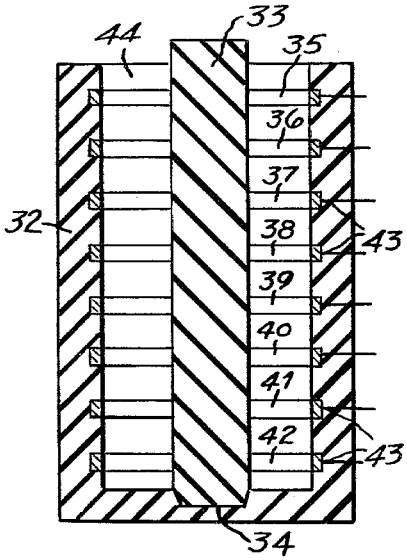
FIG. 6 is a sectional view of a mold set-up containing multiple electrode pairs for forming a tube.

A thick walled refractory tube was electrophoretically cast utilizing a mold set-up as shown in FIG. 6. This mold set-up utilized a moving electrode method but unlike the moving electrode of Example III the moving electrode in this case was not a single electrode but was a pair i.e. anode and cathode, and the pair was moved electrically rather than physically as was the single electrode in Example III.

The main body 32 of the mold set-up of FIG. 6 was made by casting RTV 664 silicone rubber around a series of spaced apart 1.3 cm thick copper rings 34–42, each ring including a lead wire 43; this was done in the conventional manner. The resulting electrophoretic casting mold had a 4 inch OD and a 3 inch ID and a depression 34 into which an arbor 33 was to be fitted. The main body 32 of the mold was cut longitudinally into two pieces. A 1 inch OD cardboard tube was coated with wax to be used as arbor 33. The two pieces of the main body 32 of the mold were clamped together and the arbor 33 inserted into the depression 34. The ring electrodes 34–42 were connected electrically through lead wires 43 in such a manner that a single pair of electrodes could become the anode and cathode and so that pair could be changed at will to a second pair, and so on through the entire group of electrodes 35–42.

A silicon carbide slip was prepared as in the preceding examples and poured into the cavity 44. A DC potential of 150 volts was applied between electrodes 40 and 42 so that 42 was the positive electrode i.e. the depository electrode. Simultaneously, the potential between electrodes 42 and 41 was monitored. When the level of the depositing silicon carbide reached the height of electrode 41 the voltage across 41 and 42 dropped to less than 1 volt. At this point the active electrode pair was changed from 42 and 40 to 41 and 39 and the potential between 41 and 40 was monitored; when that potential dropped to less than 1 volt the active electrode was moved up to the next pair, and so on until all of the electrode pairs were used and a complete green silicon carbide tube had been cast. The mold set-up was disconnected electrically, the spent slip removed, the mold set-up disassembled and the green casting removed. At this point the wax coated cardboard arbor 33 was still in place. Total casting time for the ¾" wall was up to 15 minutes per inch of length. This casting rate is well below that of capillary casting. The casting had a uniform density of 2.65 g/cc. 82% of theoretical.

The green casting was dried and fired in the same manner as the castings in the preceding examples. During the firing, the cardboard arbor 33 was thermally decomposed leaving a complete, fired, silicon carbide tube with a density of 2.60 g/cc

EXAMPLE V

A casting slip composed of 49.5 wt.% of deionized water, 0.5 wt.% of $Na_2SiO_3$ solution and 50 wt.% of silicon metal powder containing less than 1% iron, which had been abrasive jet milled to an average grain size of less than 5 microns was prepared. The molding set up of Example II was used to cast a seal ring. A potential of 30 volts DC was applied over a 15 minute period. The mold set-up was broken down as described in Example II and the piece extracted and dried at 50° C. overnight. The bulk density of the casting was 1.4 g/cc (60% of the theoretical density of 2.33 g/cc for silicon). This part was converted to $Si_3N_4$ by standard nitriding and resulted in a practice bulk of 2.3 g/cc. Test bars were cut out with a diamond saw and the modulus of rupture (3 point loading room temperature) was measured to have an average of 29,000 psi.

EXAMPLE VI

Silicon carbide castings were formed basically as described above but utilizing a substantially rectified AC voltage, i.e. what is commonly referred to as "clipped AC voltage", and also using straight DC voltage. The quality of the castings increased and the damage to the anode decreased as the degree of clipping increased; i.e. the closer the voltage wave form approached the characteristics of DC voltage, the more efficient and effective the electophoretic as the degree of clipping increased; i.e. the closer the voltage wave form approached the characteristics of DC voltage, the more efficient and effective the electrophoretic process became.

The foregoing sets out the major embodiments and best mode of practicing the invention. However, other embodiments may occur to one skilled in the art which are within the scope of the present invention.

What is claimed is:

1. An electrophoretic casting method comprising the steps of:

preparing a casting slip by mixing a liquid vehicle and an inorganic powder in such proportions that said casting slip has a viscosity of from 0.5 to 100,000 centipoises;

casting the slip into an electrophoretic mold set-up including a depository and a non-depository electrode, and wherein said depository electrode makes up less than the entire surface area of the shape defining element of the mold set-up;

applying a voltage between said electrodes thereby causing migration of the inorganic particles in said slip toward the depository electrode;

maintaining a potential until the desired degree of particle deposition has occurred;

terminating said potential;

removing the excess slip liquid;

removing the green casting from the mold set-up;

and firing the green casting.

2. The method of claim 1 wherein said casting slip includes a deflocculant.

3. The method of claim 2 wherein said deflocculant is selected from the group consisting of sodium silicate, sodium dioctylsulphosuccinate, sodium polyacrylate, ammonium polyacrylate, ethylamine, methylamine, triethanolamine, Tamol, Darvan, and mixtures thereof.

4. The method of claim 1 wherein said application of voltage is carried out by applying an initial voltage low enough so as to avoid electrochemical corrosion of said depository electrode and the decomposition of said liquid vehicle, but sufficiently high to cause the deposition of a thin layer of said inorganic powder, followed by increasing the voltage to a higher level to produce a rapid deposition rate of said inorganic powder and gradually increasing the voltage to maintain a relatively constant rate.

5. The method of claim 4 wherein said initial voltage is from 0.05 to 20 volts and said higher voltage is from 5 to 1000 volts.

6. The method of claim 1 wherein said slip has a viscosity of from 50 to 4000 centipoises.

7. The method of claim 1 wherein said fine inorganic powder has a multimodal particle size distribution and said slip is made up of from 10 to 55% by weight of liquid and 45 to 90% by weight of inorganic powder.

8. The method of claim 7 wherein said fine inorganic powder has bimodal particle size distribution composed of 40 to 90% of particles with an average particle sikze of from 0.1 to 8 microns and from 10 to 60% of particles having an average particle size of from 45 to 150 microns.

9. The method of claim 1 wherein the voltage is rendered variable by maintaining a constant current.

10. The method of claim 9 wherein said constant current is between 0 and 1.5 amperes per square inch of depository electrode area.

11. The method of claim 10 wherein said constant current is between 0 and 0.4 amperes per square inch of depository electrode area.

12. The method of claim 1 wherein said electrodes are composed of a material selected from the group consisting of steel, galvanized steel, iron, chromium, Monel metal, tantalum, titanium, copper, nickel, bronze, brass, silver, gold, platimun, silicon carbide, and electrically conductive organic polymer.

13. The method of claim 1 wherein said depository electrode is liquid mercury.

14. The method of claim 1 wherein said electrodes are silicon impregnated silicon carbide.

15. the method of claim 1 wherein at least a portion of the mold set-up is deformable so as to allow removal of said green casting from said mold set-up.

16. The method of claim 1 wherein at least a portion of the mold set-up is decomposable so as to allow removal of said green casting from said mold set-up.

17. The method of claim 1 wherein at least a portion of the mold set-up is meltable so as to allow removal of said green casting from said mold set-up.

18. The method of claim 1 wherein at least one electrode is moved relative to the other.

19. The method of claim 1 wherein both electrodes are moved relative to the casting being formed.

20. The method of claim 1 wherein the liquid vehicle is water.

21. The method of claim 1 wherein the liquid vehicle is an organic liquid.

22. The method of claim 1 wherein said green casting is frozen before removal from said mold set-up.

23. The method of claim 1 wherein said electrophoretic casting mold set-up has the surfaces, which are to contact said slip, coated with glycerol monooleate.

24. The method of claim 1 wherein said applied voltage is direct current voltage.

25. The method of claim 1 wherein said applied voltage is substantially rectified alternating current voltage.

26. An electrophoretic casting method for the formation of thick walled tubes and plates, comprising the steps of:

preparing a casting slip by mixing a liquid vehicle and an inorganic powder in such proportions that said casting slip has a viscosity of from 0.5 to 100,000 centipoises;

casting the slip into an electrophoretic mold set-up containing multiple electrodes, said electrodes having a configuration conforming to the cross-sectional shape of the green article being cast, and wherein said electrodes are of such a size that any pair of electrodes constitutes only a minor amount of the total surface area of the shape being cast;

applying a voltage across a first pair of said multiple electrodes thereby causing migration of said inorganic particles toward the anode of said first electrode pair; maintaining a voltage across said first pair of electrodes while monitoring the voltage between one of said first pair and an adjacent electrode;

terminating the voltage between said first electrode pair when the voltage between one of said first electrode pair and the adjacent electrodes drops to less than one volt, and reapplying the voltage to a second electrode pair adjacent to the first electrode pair;

applying a voltage across said second electrode pair and repeating the process steps utilized with said first electrode pair;

repeating the steps utilized with said first and second electrode pairs with subsequent adjacent electrode pairs until the desired green casting has been completely formed;

terminating said voltage;

removing the excess slip;

removing the green casting from the mold set-up;

and firing the green casting.

* * * * *